United States Patent [19]

Zoltner

[11] Patent Number: 4,478,512

[45] Date of Patent: Oct. 23, 1984

[54] TONER CARTRIDGE FOR USE IN AN ELECTROPHOTOGRAPHIC PRINTING MACHINE

[75] Inventor: John D. Zoltner, Rochester, N.Y.

[73] Assignee: Xerox Corporation, Stamford, Conn.

[21] Appl. No.: 493,464

[22] Filed: May 11, 1983

[51] Int. Cl.[3] ..... G03G 15/08

[52] U.S. Cl. ..... 355/3 DD; 206/633; 222/DIG. 1

[58] Field of Search ..... 355/3 DD, 14 D; 222/DIG. 1, 325; 206/633

[56] References Cited

U.S. PATENT DOCUMENTS

| | | | |
|---|---|---|---|
| 2,904,000 | 9/1959 | Fisher et al. | 118/657 |
| 3,339,807 | 9/1967 | Eichorn | 222/171 |
| 3,356,248 | 12/1967 | Del Vecchio | 222/DIG. 1 |
| 3,385,500 | 5/1968 | Lavander | 229/7 |
| 3,501,065 | 3/1970 | Altmann et al. | 222/392 |
| 3,539,077 | 11/1970 | Drexler et al. | 222/82 |
| 3,618,826 | 11/1971 | Kangas et al. | 222/166 |
| 3,999,654 | 12/1976 | Pollack | 206/216 |
| 4,062,385 | 12/1977 | Katusha et al. | 141/89 |
| 4,065,335 | 12/1977 | Pollack | 156/69 |
| 4,089,601 | 5/1978 | Navone | 355/3 DD X |

*Primary Examiner*—John Gonzales
*Assistant Examiner*—J. Pendegrass
*Attorney, Agent, or Firm*—H. Fleischer; J. E. Beck; R. Zibelli

[57] ABSTRACT

A cartridge in which marking particles used in an electrophotographic printing machine are stored. The cartridge has an opening in the surface thereof for discharging the marking particles therefrom. A flexible sealing strip is secured removably to the cartridge and seals the opening in the surface to prevent the discharge of the marking particles. The sealing strip is folded back over itself in juxtaposition. A flexible backing strip has the portion of the sealing strip folded back secured thereto. As the sealing strip is removed from the cartridge, successive portions thereof are secured to the backing strip. The foregoing occurs automatically when the cartridge is inserted in a dispensing unit of the printing machine and rotated. In this way, the cartridge is sealed when inserted in the printing machine and, after being rotated, automatically opened to discharge marking particles into the dispensing unit of the printing machine.

10 Claims, 4 Drawing Figures

TONER CARTRIDGE FOR USE IN AN ELECTROPHOTOGRAPHIC PRINTING MACHINE

This invention relates generally to an electrophotographic printing machine, and more particularly concerns a toner cartridge for discharging additional toner particles into the toner dispenser of the development system used in the printing machine.

Generally, an electrophotographic printing machine includes a photoconductive member which is charged to a substantially uniform potential to sensitize the surface thereof. The charged portion of the photoconductive member is exposed to a light image of an original document being reproduced. This records an electrostatic latent image on the photoconductive member corresponding to the informational areas contained within the original document. In lieu of an original document, a light beam may be modulated and used to selectively discharge portions of the charged photoconductive surface to record the desired information thereon. A system of this type typically employs a laser beam. After recording the electrostatic latent image on the photoconductive member, the latent image is developed by bringing a developer material into contact therewith. Generally, the developer material comprises toner particles adhering triboelectrically to carrier granules. The toner particles are attracted to the latent image from the carrier granules to form a powder image on the photoconductive member which is subsequently transferred to a copy sheet. Finally, the copy sheet is heated to permanently affix the powder image thereto in image configuration.

As the toner particles are depleted from the developer material, it is necessary to dispense additional toner particles into the developer mixture. In this way, the consideration of toner particles within the developer mixture is maintained substantially constant. To achieve this, electrophotographic printing machines frequently have dispensers which discharge toner particles into the development system. After a period of time, it is necessary to replenish the toner particles within the dispenser. When adding additional toner particles to the dispenser in the printing machine, any spillage results in contamination of the areas having the spilled toner particles thereon. The toner particles, being very finely ground, also become airborne carrying this contamination to other areas not immediately adjacent the development system. Furthermore, the spilled toner particles also have a tendency to cling to the operator's hands or to the surrounding environment. It is thus clear that the addition of toner particles into the printing machine is a dirty and messy job which frequently inadvertently spills on the operator's hands and clothing. It is, therefore, highly desirable to package the toner particles in a manner such that the contamination of both the operator and the printing machine is minimized.

Various approaches have been devised to improve toner cartridges used to furnish additional toner particles to the dispenser of the development system used in an electrophotographic printing machine. The following disclosures appear to be relevant:

U.S. Pat. No. 2,904,000
Patentee: Fisher et al.
Issued: Sept. 15, 1959
U.S. Pat. No. 3,339,807

Patentee: Eichorn
Issued: Sept. 5, 1967
U.S. Pat. No. 3,385,500
Patentee: Lavander
Issued: May 28, 1968
U.S. Pat. No. 3,501,065
Patentee: Altmann et al.
Issued: Mar. 17, 1970
U.S. Pat. No. 3,539,077
Patentee: Drexler et al.
Issued: Nov. 10, 1970
U.S. Pat. No. 3,618,826
Patentee: Kangas et al.
Issued: Nov. 9, 1971
U.S. Pat. No. 3,999,654
Patentee: Pollack
Issued: Dec. 28, 1976
U.S. Pat. No. 4,062,385
Patentee: Katusha et al.
Issued: Dec. 13, 1977
U.S. Pat. No. 4,065,335
Patentee: Pollack
Issued: Dec. 27, 1977

The pertinent portions of the foregoing disclosures may be briefly summarized as follows:

Fisher et al. discloses a toner magazine having a container consisting of an elongated, generally rectangular plastic box with the bottom wall thereof having a number of apertures therein. During storage and prior to actual use, the apertures are covered by a strip of plastic tape. The tape is removed just before the container is inserted for use in the magazine.

Eichorn describes a toner package having a cylindrical body with several openings therein. The openings are sealed by a tear strip or cover with a tab which is easily removable by hand before insertion into the dispensing apparatus of the printing machine. Toner particles are discharged from the toner package through the openings therein.

Lavander discloses a toner package consisting of a rectangular cardboard body. The bottom portion of the container defines a removable tear strip which extends along the bottom of the container. The strip includes a tab portion which extends beyond the length of the toner package. The tab portion has an opening therein which is gripped by a protruding portion of a slide. The toner package and the slide are then both placed into the toner dispenser along guide rails. The slide is then removed pulling the bottom strip from the toner package. This discharges the toner particles into the toner dispenser.

Altmann et al. describes a toner container in which a flexible web or lining at least partially defines a volume for receiving toner particles. The web is attached to a shaft which is coupled to a drive in the dispensing mechanism arranged to receive the container. As the drive turns, the shaft takes up the web and pushes the toner through openings in the container so as to discharge it into the dispenser.

Drexler et al. describes a toner container having an openable end constructed from a slittable material, such as paper, forming a seal over the container. As the container is inserted into the toner dispenser in the electrophotographic printing machine, a stationary knife slits the slittable material sealing the top of the container. The toner particles are then discharged from the container into the toner dispenser.

Kangas et al. discloses a container 12 having discharge openings therein. A removable strip is secured to the container covering the discharge openings. The strip covering the discharge openings is removed and the container inserted into the toner dispenser. The container is then rotated 180° to discharge the developer material through the discharge openings.

The Pollack patents describe a toner cartridge having a flexible tongue which is folded back over itself and covers the opening in the cartridge. The tongue is then peeled from the cartridge to dispense toner particles therefrom.

Katusha et al. describes a toner container having a removable tear strip which seals an opening in the container. A slidable cover automatically removes the tear strip from the container permitting the discharge of toner particles into the toner dispenser of the electrophotographic printing machine.

In accordance with one aspect of the present invention, there is provided an apparatus for storing a supply of marking particles therein. A container defines a chamber for storing the marking particles therein. The container has an opening in the surface thereof for the discharge of marking particles therefrom. A flexible sealing strip has a portion thereof removably secured to the container sealing the opening in the surface thereof to prevent the discharge of the marking particles therefrom. The sealing strip is folded in juxtaposition. A flexible backing strip of a length at least equal to the unfolded length of the sealing strip has the surface of the sealing strip folded in juxtaposition secured thereto. The remaining surface of the backing strip is arranged to receive successive portions of the sealing strip during the removal thereof from the container.

Pursuant to another aspect of the present invention, there is provided an electrophotographic printing machine of the type having an electrostatic latent image recorded on a photoconductive surface and a development system arranged to transport a developer mixture of carrier granules having toner particles adhering triboelectrically thereto closely adjacent to the latent image so that at least a portion of the toner particles are attracted from the carrier granules to the latent image forming a toner powder image on the photoconductive surface. The printing machine includes means for dispensing toner particles into the development system. A toner cartridge is arranged to be operatively associated with the dispensing means. The toner cartridge has a chamber for storing a supply of toner particles therein and an opening in the surface thereof for the discharge of the toner particles therefrom. A flexible sealing strip having a portion thereof removably secured to the cartridge seals the opening in the surface thereof to prevent the discharge of the toner particles from the chamber therein. The sealing means is folded in juxtaposition. A flexible backing strip of a length at least equal to the unfolded length of the sealing strip has the surface of the sealing strip folded in juxtaposition secured to a portion thereof. The remaining portion of the backing strip is arranged to receive successive portions of the sealing strip during the removal thereof from the cartridge when the cartridge is operatively associated with the dispensing means. In this way, toner particles are discharged from the chamber of the cartridge into the dispensing means.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
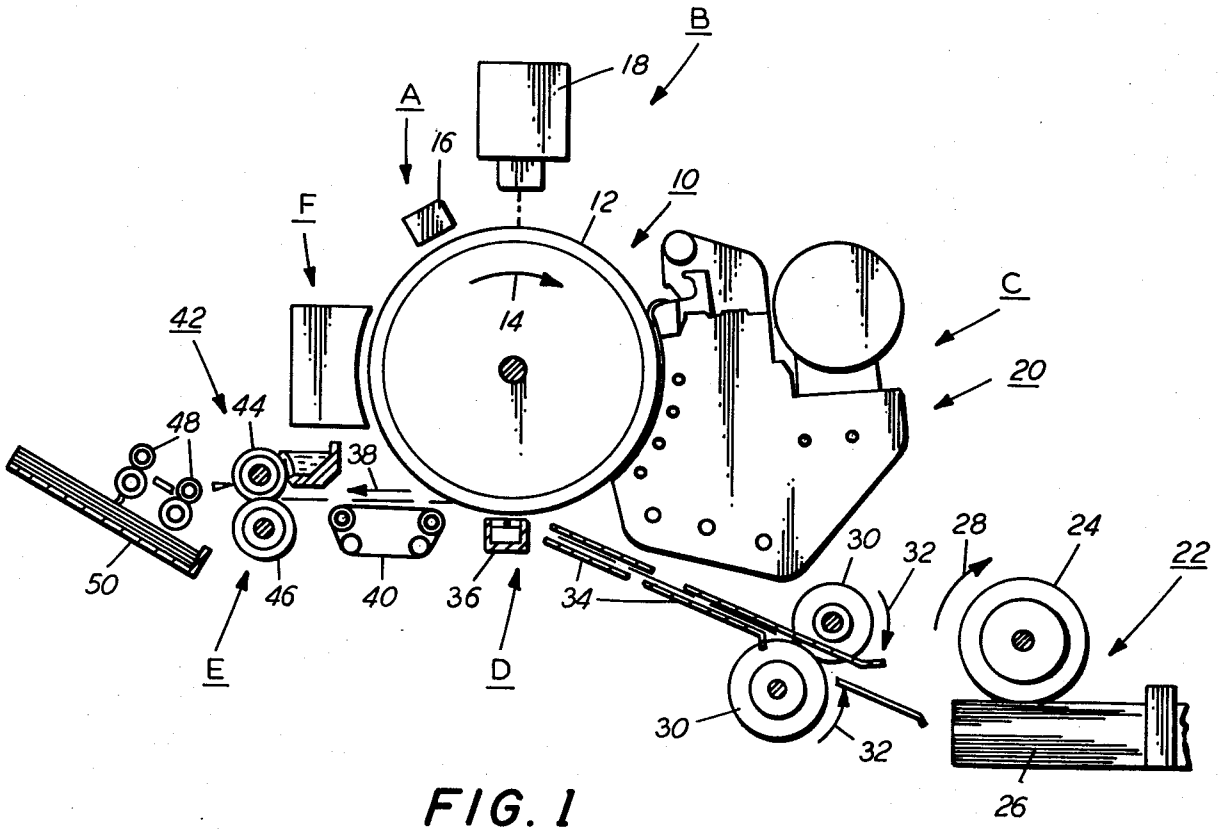
FIG. 1 is a schematic elevational view depicting an electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the toner cartridge of the present invention therein. It will become evident from the following discussion that this toner cartridge is equally well suited for use in a wide variety of electrostatographic printing machines, and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface 12. Preferably, photoconductive surface 12 comprises a selenium alloy adhering to a conductive substrate, i.e. an electrically grounded aluminum alloy. Drum 10 moves in the direction of arrow 14 to advance photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantially uniform potential.

Next, the charged portion of photoconductive surface 12 is advanced through imaging station B. Imaging station B includes an exposure system, indicated generally by the reference numeral 18. Exposure system 18 includes a light source which illuminates an original document positioned facedown upon a transparent platen. Light rays reflected from the original document are transmitted through a lens to form a light image thereof. The light image is focused on the charged portion of photoconductive surface 12 to selectively dissipate the charge thereon. This records an electrostatic latent image on photoconductive surface 12 which corresponds to the informational areas contained within the original document. One skilled in the art will appreciate that an optical system of the foregoing type need not be the only type of system employed to selectively dissipate the charge on the photoconductive surface.

For example, a modulated light beam, such as a laser beam, may be used to irradiate the charged portion of the photoconductive surface to selectively dissipate the charge recording the desired information thereon. After the electrostatic latent image is recorded on photoconductive surface 12, drum 10 advances the latent image to development station C.

At development station C, a magnetic brush development system, indicated generally by the reference numeral 20, advances a developer material of carrier granules having toner particles adhering triboelectrically thereto into contact with the electrostatic latent image. The latent image attracts the toner particles from the carrier granules of the developer material to form a toner powder image on photoconductive surface 12 of drum 10. As the toner particles are attracted to the latent image, the concentration thereof, in the developer material, decreases. Thus, additional toner particles are furnished to the development system from a toner dispenser incorporated therein. In this way, the concentration of toner particles within the developer material is maintained substantially constant to achieve optimum copy quality. However, additional toner particles must be furnished periodically to the toner dispenser. A toner cartridge, inserted in the toner dispenser, discharges toner particles thereto. The detailed structure of the development system and the toner cartridge will be described hereinafter with reference to FIGS. 2 through 4, inclusive.

Drum 10 then advances the toner powder image to transfer station D. At transfer station D, a sheet of support material is moved into contact with the powder image. The sheet of support material is advanced to transfer station D by a sheet feeding apparatus, indicated generally by the reference numeral 22. Preferably, sheet feeding apparatus 22 includes a feed roll 24 contacting the uppermost sheet of a stack of sheets 26. Feed roll 24 rotates in the direction of arrow 28 to advance the uppermost sheet into the nip defined by forwarding rollers 30. Forwarding rollers 30 rotate in the direction of arrow 32 to advance the sheet into chute 34. Chute 34 directs the advancing sheet of support material into contact with photoconductive surface 12 of drum 10 so that the toner powder image developed thereon contacts the advancing sheet at transfer station D.

Preferably, transfer station D includes a corona generating device 36 which sprays ions onto the backside of the sheet. This attracts the toner powder image from photoconductive surface 12 to the sheet. After transfer, the sheet continues to move in the direction of arrow 38 onto a conveyor 40 which advances the sheet to fusing station E.

Fusing station E includes a fuser assembly, indicated generally by the reference numeral 42, which permanently affixes the transferred toner powder image to the sheet. Preferably, fuser assembly 42 includes a heated fuser roller 44 and a back-up roller 46. A sheet passes between fuser roller 44 and back-up roller 46 with the toner powder image contacting fuser roller 44. In this manner, the toner powder image is permanently affixed to the sheet. After fusing, forwarding rollers 48 advance the sheet to catch tray 50 for removal from the printing machine by the operator.

Invariably, after the sheet of support material is separated from photoconductive surface 12 of drum 10, some residual particles remain adhering thereto. These residual particles are removed from photoconductive surface 12 at cleaning station F. Preferably, cleaning station F includes a rotatably mounted brush in contact with photoconductive surface 12. Particles are cleaned from photoconductive surface 12 by the rotation of the brush in contact therewith. Subsequent to cleaning, a discharge lamp floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
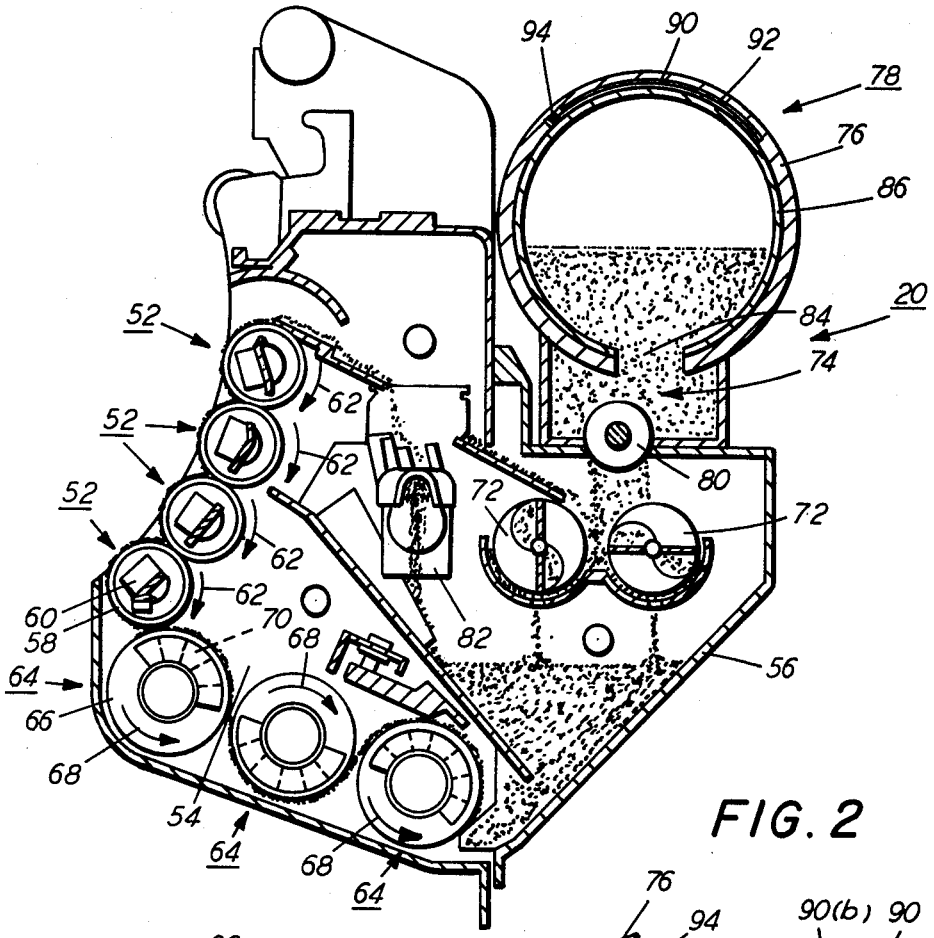
FIG. 2 is a schematic elevational view showing the development system used in the FIG. 1 printing machine.

Referring now to FIG. 2, there is shown development system 20 in greater detail. As depicted thereat, development system 20 includes a plurality of developer rollers 52. Each developer roller is identical to one another and thus, only one developer roller will be described. All of the developer rollers are mounted in chamber 54 of housing 56. Each developer roller 52 includes a non-magnetic tubular roll 58 journaled for rotation. By way of example, tubular roll 58 is made from stainless steel having the exterior circumferential surface thereof roughened. An elongated magnet 60 is positioned concentrically within tubular roll 58 and spaced from the interior circumferentially surface thereof. Magnet 60 is preferably made from barium ferrite. A voltage source (not shown) electrically biases each of the developer rollers 52 to a selected magnitude and polarity. Preferably, the magnitude of the electrical bias is to a level intermediate that of the background voltage and the image voltage level recorded on photoconductive surface 12 of drum 10. By way of example, the voltage source may electrically bias each of the developer rollers to a voltage ranging from about 300 volts to about 800 volts. Tubular member 58 of developer roller 52 rotates in the direction of arrow 62 to advance the developer material closely adjacent to the photoconductive surface of drum 10. In this way, the toner particles are attracted from the carrier granules to form a toner powder image on the photoconductive surface corresponding to the informational areas contained within the original document. A plurality of transport rollers, indicated generally by the reference numeral 64, advance the developer material to the developer rollers. Inasmuch as each of the transport rollers 64 are substantially identical to one another, only one will be described hereinafter. Transport roller 64 also comprises a tubular member 66 preferably made from stainless steel having the exterior circumferential surface thereof roughened. Tubular member 66 rotates in the direction of arrows 68. A magnet 70 is disposed interiorly of tubular member 66 and spaced therefrom. A pair of mixing augers 72 mix the fresh toner particles being discharged from dispenser 74 with the denuded carrier granules and unused developer material being returned to chamber 54 of housing 56. Dispenser 74 includes a housing 76 for receiving a toner cartridge, indicated generally by the reference numeral 78. A foam roll 80 is disposed in the opening of housing 76 to dispense toner particles therefrom.

In operation, toner cartridge 78 is inserted into housing 76 of toner dispenser 74. Roller 80 dispenses toner particles from housing 76 onto augers 72. Augers 72 mix the freshly dispensed toner particles with the denuded carrier granules and unused developer material. This mixture is then returned to chamber 54 of housing 56.

Figure 3:
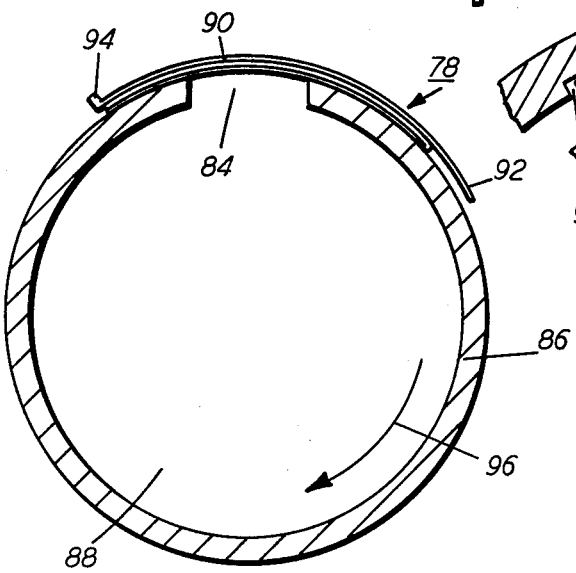
FIG. 3 is a schematic elevational view illustrating the toner cartridge used in the FIG. 2 development system.

Transport roller 64 advance the freshly mixed developer material to developer rollers 52. Developer rollers 52 moves the developer material closely adjacent to the photoconductive surface. The latent image recorded on the photoconductive surface attracts toner particles from the carrier granules. After development, the unused developer material and denuded carrier granules are returned to augers 72 for subsequent mixing with the freshly dispensed toner particles from dispenser 74. The concentration of toner particles within the developer mix is sensed by developability control system 82. Developability control system 82 measures the concentration of toner particles within the developer material and generates an error signal in response thereto for actuating roller 80. In this way, the dispensing of toner particles from housing 76 is controlled to maintain the concentration of toner particles within the developer material at an optimum level. As shown in FIG. 2, toner cartridge 78 is positioned with the opening 84 in container 86 in communication with housing 76 for the discharge of the toner particles thereto. Referring now to FIG. 3, there will be shown the detailed construction of toner cartridge 78.

As shown in FIG. 3, toner cartridge 78 includes a container 86 having an opening 84 therein. Container 86 is tubular and defines an interior chamber 88 for storing the toner particles therein. A sealing strip 90 has one portion thereof positioned over opening 84. Sealing strip 90 is adhesively secured to container 86 over opening 84 and is folded back over itself in juxtaposition. Thus, surface 90(*a*) of sealing strip 90 is secured to container 86 with surface 90(*b*) being secured to backing strip 92. By way of example, backing strip 92 may be made from paper with sealing strip 90 being made from suitable plastic or paper. In either case, both sealing strip 90 and backing paper 92 are flexible. Sealing strip 90 has an adhesive coating on the surface 90(*a*) thereof in contact with container 86. The opposite surface thereof, i.e. surface 90(*b*), is adhesively secured to backing strip 92. A key or protuberance 94 is integral with and extends upwardly from backing strip 92. When toner cartridge 78 is inserted in housing 76, key 94 mates with a slot therein preventing the movement thereof. As shown, toner cartridge 78 has the opening 84 therein sealed with sealing strip 90. After being inserted in housing 76, container 86 is rotated in the direction of arrow 96. Inasmuch as key 94 holds backing strip 92 and sealing strip 90 in position relative to housing 76 by being secured in a slot in housing 76, both backing strip 92 and sealing strip 90 remain fixed and do not rotate with container 86. As container 86 is rotated in the direction of arrow 96, successive portions of sealing strip 90(*a*) are removed from opening 84 and secured to backing strip 92. After container 86 has been rotated, in the direction of arrow 96, through 180°, sealing strip 90 is completely removed from opening 84 in container 86 and secured to backing strip 92. In this latter position, toner particles are discharged from chamber 88 through opening 84 into dispenser 74. The unfolded length of sealing strip 90 is substantially equal to the length of backing strip 92. It is thus seen that both backing strip 92 and sealing strip 90 remain secured to container 86. After all of the toner particles have been discharged therefrom, container 86 may be removed from housing 76 with both the backing strip and sealing strip secured thereto. The used cartridge may now be discarded. The foregoing process is essentially a "white glove" operation wherein no toner particles are permitted to escape from the system and the operator's hands and clothes remain clean. By way of example, sealing strip 90 may be a pressure sensitive tape, a heat activated paper adhesive material or a similar polyester seal.

Figure 4:
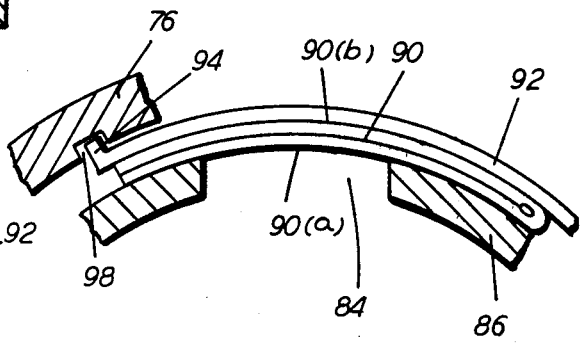
FIG. 4 is a fragmentary sectional elevational view showing sealing strip held by the dispenser housing.

Referring now to FIG. 4, there is shown means for holding sealing strip 90 and backing strip 92 stationary as housing 80 is rotated. As depicted thereat, key 94 is mounted in slot 98 of housing 76. Key 94 is integral with and extends upwardly from backing strip 92. When cartridge 78 is inserted in housing 76, key 94 mates with slot 98 in housing 76. In this way, slot 98 holds key 94 preventing backing strip 92 and sealing strip 90 from moving as container 86 is rotated.

In recapitulation, the toner cartridge of the present invention comprises a container having an opening therein which is sealed by a sealing strip folded back over itself in juxtaposition. The surface of the sealing stripopposed from the surface sealing the opening in the container is secured to a backing strip. A key extends upwardly from one marginal end region of the backing strip. The key mates with a slot in the dispenser housing after the toner cartridge is inserted therein. As the toner cartridge is rotated, the key prevents the sealing strip and backing strip from rotating therewith. In this way, the sealing strip is removed from the opening and secured to the backing strip. After the container has rotated through 180°, the opening in the container is positioned to discharge toner particles into the toner dispenser for use in the development system of the printing machine.

It is, therefore, evident that there has been provided in accordance with the present invention, a toner cartridge which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for storing a supply of marking particles therein including:

a container defining a chamber for storing the marking particles therein and having an opening in the surface thereof for the discharge of the marking particles therefrom;

a flexible sealing strip having a portion thereof secured removably to said container sealing the opening in the surface thereof to prevent the discharge of the marking particles therefrom, said sealing strip being folded in juxtaposition; and a flexible backing strip being of a length at least equal to the unfolded length of said sealing strip and having the surface of said sealing strip folded in juxtaposition secured to a portion of the surface of said backing strip with the remaining surface of said backing strip being arranged to receive successive portions of said sealing strip during the removal thereof from said container.

2. An apparatus according to claim 1, further including means for preventing the movement of said backing strip and said sealing strip with said container.

3. An apparatus according to claim 2, wherein said preventing means includes a protuberance extending upwardly from one marginal region of said backing strip.

4. An apparatus according to claim 3, wherein said preventing means includes means for locking said protuberance to prevent the movement thereof with said container so that movement of said container relative thereto separates at least successive portions of said sealing means sealing the opening in the surface of said container permitting the discharge of the marking particles from the chamber thereof.

5. An apparatus according to claim 4, wherein said container is tubular and rotation thereof separates at least the portion of said sealing means sealing the opening in the surface thereof.

6. An electrophotographic printing machine of the type having an electrostatic latent image recorded on a photoconductive surface and a development system arranged to transport a developer mixture of carrier granules having toner particles adhering triboelectrically thereto closely adjacent to the latent image so that at least a portion of the toner particles are attracted from the carrier granules to the latent image forming a toner powder image on the photoconductive surface, wherein the improvement includes:

means for dispensing toner particles into the development system;

a toner cartridge arranged to be operatively associated with said dispensing means and defining a chamber for storing a supply of toner particles therein, said toner cartridge having an opening in the surface thereof for the discharge of the toner particles therefrom;

a flexible sealing strip having a portion thereof secured removably to said cartridge sealing the opening in the surface thereof to prevent the discharge of the toner particles from the chamber therein, said sealing means being folded in juxtaposition; and a flexible backing strip being of a length at least equal to the unfolded length of said sealing strip and having the surface of said sealing strip folded in juxtaposition secured to a portion of said backing strip with the remaining portion of said backing strip being arranged to receive successive portions of said sealing strip during the removal thereof from said cartridge when said cartridge is operatively associated with said dispensing means for the discharge of the toner particles from the chamber of said cartridge into said dispensing means.

7. A printing machine according to claim 6, further including means for preventing the movement of said backing strip and said sealing strip with said cartridge.

8. A printing machine according to claim 7, wherein said preventing means includes a protuberance extending upwardly from one marginal region of said backing strip.

9. A printing machine according to claim 8, wherein said dispensing means includes means for locking said protuberance to prevent the movement thereof with said cartridge so that movement of said cartridge relative to said dispensing means separates at least successive portions of said sealing means sealing the opening in the surface of said cartridge permitting the discharge of the toner particles from the chamber in said cartridge into said dispensing means.

10. A printing machine according to claim 9, wherein said container is tubular and rotation thereof separates at least the portion of said sealing means sealing the opening in the surface thereof.

* * * * *